US005314303A

United States Patent [19]

Charbonnel et al.

[11] Patent Number: 5,314,303

[45] Date of Patent: May 24, 1994

[54] DEVICE FOR CHECKING THE CLEARANCES OF A GAS TURBINE COMPRESSOR CASING

[75] Inventors: Jean-Louis Charbonnel, Le Mee sur Seine; Jacky Naudet, Bondoufle; Gérard J. Stangalini, Fontainebleau, all of France

[73] Assignee: Societe Nationale d'Etude et de Construction de Moteurs d'Aviation "SNECMA", Paris, France

[21] Appl. No.: 298

[22] Filed: Jan. 4, 1993

[30] Foreign Application Priority Data

Jan. 8, 1992 [FR] France ..... 92 00103

[51] Int. Cl.[5] ..... F01D 5/20

[52] U.S. Cl. ..... 415/173.1; 415/173.3; 415/115

[58] Field of Search ..... 415/173.1, 173.3, 173.6, 415/174.2, 134, 135, 138, 115, 116, 177

[56] References Cited

U.S. PATENT DOCUMENTS

| | | | |
|---|---|---|---|
| 3,975,901 | 8/1976 | Hallinger et al. | 415/115 |
| 5,080,557 | 1/1992 | Berger | 415/173.3 |
| 5,092,737 | 3/1992 | Lau | 415/173.2 |
| 5,098,257 | 3/1992 | Hultgren et al. | 415/115 |

FOREIGN PATENT DOCUMENTS

| | | |
|---|---|---|
| 2589520 | 5/1987 | France . |
| 1484288 | 9/1977 | United Kingdom . |

*Primary Examiner*—John T. Kwon

*Attorney, Agent, or Firm*—Oblon, Spivak, McClelland, Maier & Neustadt

[57] ABSTRACT

A gas turbine compressor casing has two inner and outer envelopes forming at least one closed cavity and a locking or clamping ring having a thermal inertia higher than that of the envelopes and mounted in the closed cavity in such a way as to limit its contraction during a lowering of the temperature. The thermal inertia difference can be obtained by using for the locking ring a material having a thermal expansion coefficient lower than the coefficient of the envelopes. It can also be controlled by a ventilation means device for ensuring hot air flow in the cavity.

9 Claims, 5 Drawing Sheets

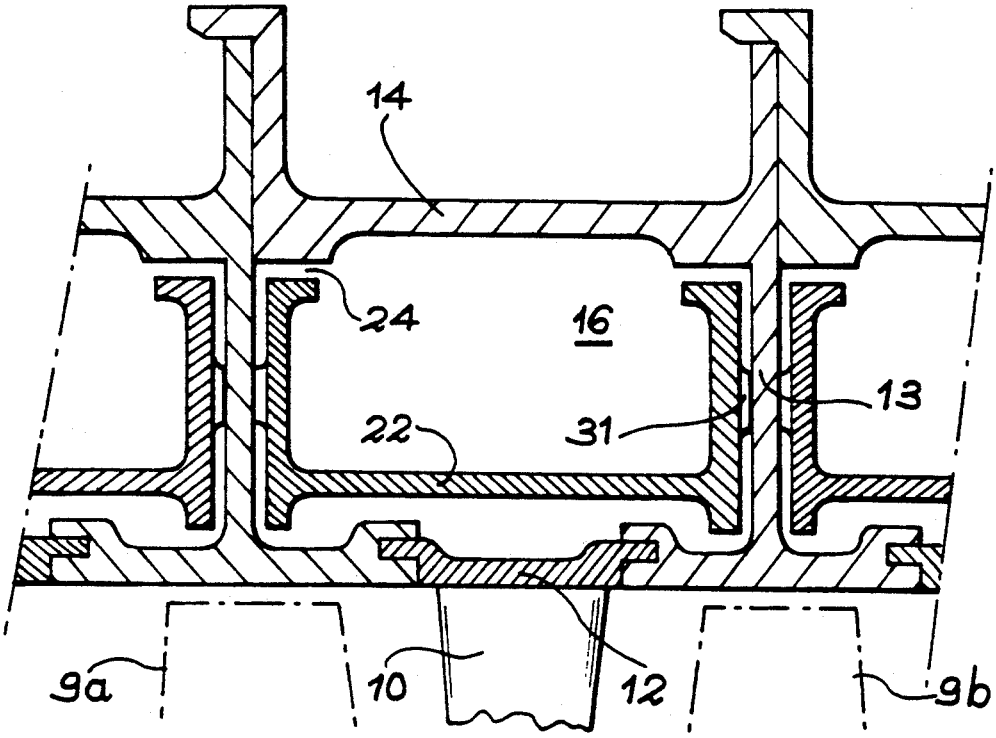
FIG. 2A
FIG. 2B
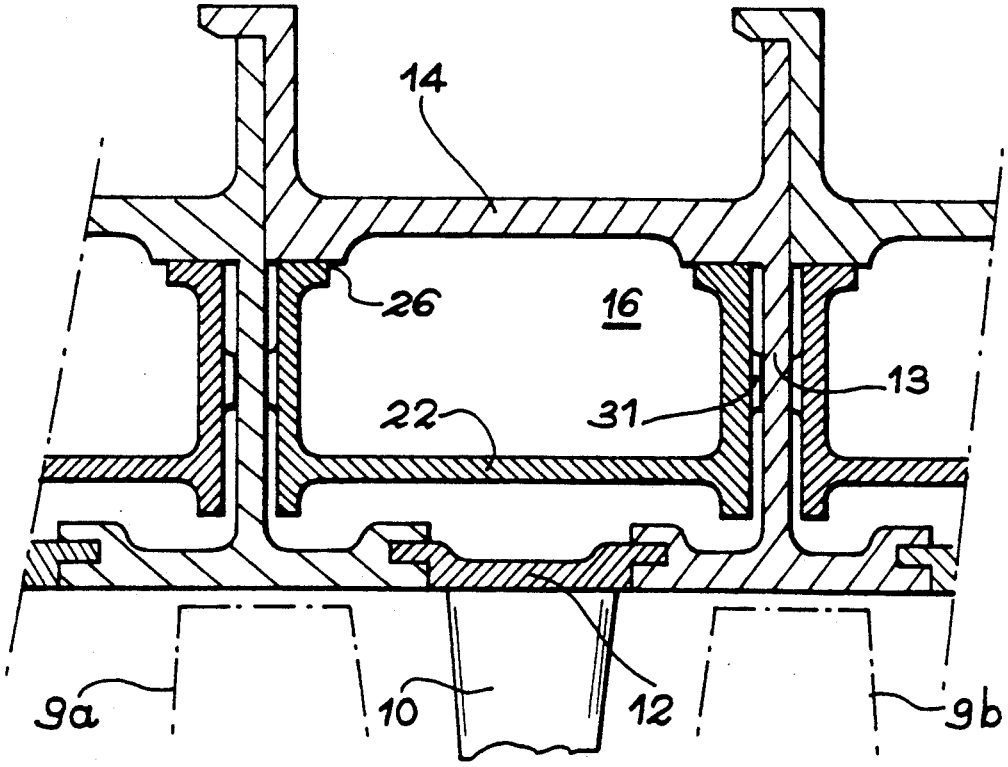

DEVICE FOR CHECKING THE CLEARANCES OF A GAS TURBINE COMPRESSOR CASING

BACKGROUND OF THE INVENTION

1. Field of the Invention

The present invention relates to a device making it possible to check or control the clearances of a high pressure compressor casing of a gas turbine. This device can be used for numerous types of gas turbine for aircraft engines.

2. Discussion of the Background

The high heating levels to which a gas turbine is exposed during the flight of an aircraft lead to thermal expansion, which should be controlled in order to improve the performance characteristics of the gas turbine. More particularly, it is important to control the radial clearances between the rotor and the stator, i.e. limit said clearances during the accelerating and cruising phases (essential phases during flying), while avoiding mechanical interference between the fixed part (i.e., stator) and the rotary part (i.e., rotor) of the compressor during a transient phase of the deceleration type with reacceleration.

Several documents propose devices for controlling such clearances and are usually in the form of compressor stators having a double envelope casing, namely an inner envelope supporting the stator blades and an outer envelope, said two envelopes being joined by flexible connections.

French patent application 2,607,198, filed on Nov. 26, 1986 by the present Applicant, proposes a compressor casing comprising an inner envelope having circumferential corrugations, whereof the valleys are located level with the medium of a blade stage and the crests are located at the blade edges. Rows of flexible pillars connect and join the inner and outer envelopes.

FR-2,640,687 proposes installing a plurality of deformable cylindrical bellows within which a variable pressure is maintained by an air sampling duct at the downstream end of the compressor.

The two aforementioned devices make it possible to limit the risks of mechanical interference between the stator and the rotor, but their use is difficult.

French patent application 2,653,171 describes a gas turbine compressor casing constituted by two inner and outer envelopes forming an enclosure and supplied with hot air by a downstream opening. The two envelopes are connected by hollow connecting arms and are linked with an air ventilating circuit or system permitting the circulation of cooling air within the arms. This device requires a cooling circuit for the casing in the essential flight stages of cruising and acceleration and this is expensive from the delivery standpoint.

SUMMARY OF THE INVENTION

The present invention has the advantage of proposing a compressor casing making it possible to control the clearances on the casing without having to have recourse to any cooling of the casing and whose use and operation are relatively easy.

More specifically, the invention relates to a gas turbine compressor casing having a structure forming the casing, characterized in that it also has a locking member having a thermal inertia higher than that of the structure and mounted in the latter in such a way as to limit its contraction during the lowering of the temperature.

Advantageously, the locking member is made from a material having a lower thermal expansion coefficient than that of the structure. In addition, the structure forming the casing has an inner envelope and an outer envelope forming at least one closed or sealed cavity.

According to an embodiment of the invention, the casing also has ventilating means ensuring hot air circulation within the structure.

Preferably, the locking or clamping member is a ring, which cooperates with the structure by guidance means opposing rotation about an axis of the casing.

According to the invention, the guidance means comprise a support able to pivot in partitions of the structure in order to ensure a free expansion and/or contraction of the ring.

According to a variant of the invention, the casing also has thermal insulating means arranged around the inner envelope. These thermal insulating means advantageously constitute a substantially cylindrical part of the locking member.

BRIEF DESCRIPTION OF THE DRAWINGS

The invention is described in greater detail hereinafter relative to non-limitative embodiments and with reference to the attached drawings, wherein show:

FIG. 2A and 2B are partial diagrammatic representations in longitudinal section through a plane passing through the rotation axis of the compressor of a casing according to the invention, FIG. 2A showing the clearance between the casing structure and the ring during the engine accelerating phase and FIG. 2B the locking existing between the structure and the ring during the engine deceleration phase.

DESCRIPTION OF THE PREFERRED EMBODIMENT

Figure 1:
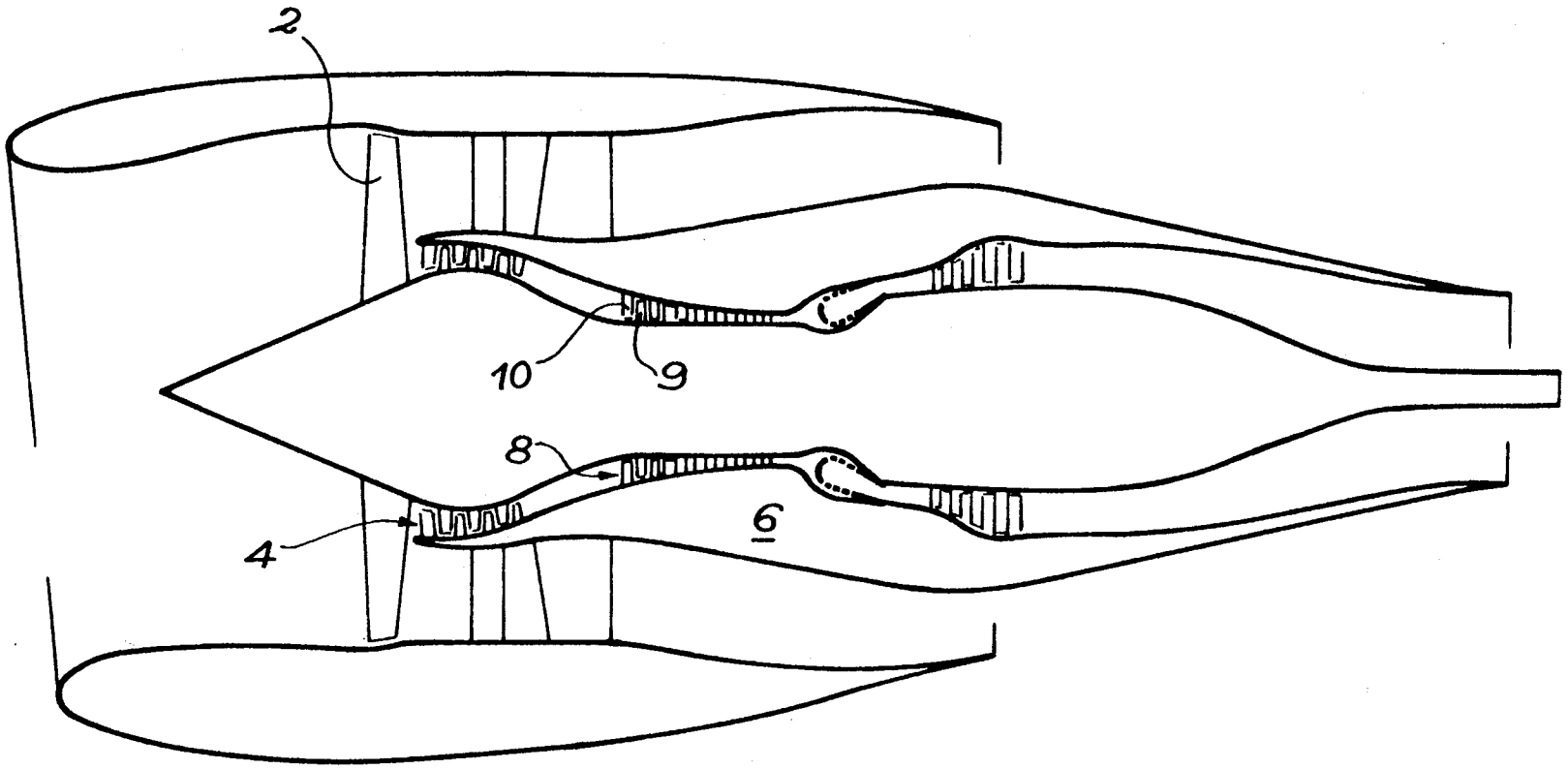
FIG. 1 is an overall diagram showing an example of a turbo-jet engine.

FIG. 1 is a general diagram of an aircraft turbo-jet engine. It is possible to see various stages of the gas turbine, namely the blower 2 constituting its first stage, the low pressure compressor 4 and the high pressure compressor or HP compressor 8. A ventilation compartment 6 makes it possible to cool the HP compressor stage 8, which has a rotor and a stator symbolized in the drawing by their respective blades 9 and 10. The device according to the invention relates to the casing of said HP compressor 8 or stator.

In addition, FIGS. 2A and 2B show in longitudinal sectional form and partly diagrammatically the casing of the HP compressor 8. This axial compressor has two envelopes, namely an inner envelope 12 and an outer envelope 14, constituting the casing structure. These two envelopes are radially spaced and together form a cavity 16.

As for most axial compressors, a certain number of circular rows of blades are fixed to the inner envelope 12 forming the stator stages of the HP compressor. Between two stator stages is placed a mobile blade stage fixed to the rotor. FIGS. 2A and 2B show a stator stage 10 and two blade stages 9*a*,9*b* of the rotor.

As explained hereinbefore, it is necessary to have a clearance between the mobile blade stages 9*a*,9*b* and the inner envelope 12, as well as between the stator stages 10 and the central part of the rotor, not shown in the drawing.

During the essential flight phases, i.e. acceleration and cruising, the ambient temperature is high and the casing structure 12–14 expands, which ensures the necessary clearance between the stator and the rotor. During the deceleration phase, the expanded casing structure 12–14 contracts. Thus, in the case where it is necessary to reaccelerate when the deceleration phase is not completed, the clearance between the stator and the rotor is no longer ensured. The ring 22 located within the casing cavity 16 makes it possible to limit the contraction of the casing structure 12–14.

More specifically, flexible connections 13 connect and join the outer 14 and inner 12 envelopes. These flexible connections 13, according to an embodiment of the invention, can form an integral part of the outer envelope 14. Therefore the cavity 16 is a closed cavity within which is located the ring 22. The ring 22 substantially adopts the shape of the cavity 16, i.e. it has a diameter well below the height of the cavity 16, the height of the latter being the distance between the two envelopes 12 and 14. It is maintained within said cavity 16 by guidance means 31. The ring 22 has a thermal inertia higher than that of the envelopes 12 and 14.

According to a preferred embodiment of the invention, said thermal inertia difference results from the difference of the expansion coefficients of the materials constituting on the one hand the envelopes and on the other the ring. Thus, the ring 22 is made from a material having a lower expansion coefficient than that of the envelopes.

Thus, as a function of the flight phases, the expansion and contraction reactions of the ring differ in time from those of the envelopes and in particular the outer envelope 14 (as shown in FIGS. 2A and 2B).

In the acceleration phase, the temperature rises continuously. The outer envelope 14 of the casing has a lower thermal inertia than that of the ring 22, so that it expands more than the latter. In other words, from a time standpoint, it can be considered that the ring 22 expands with a certain time lag compared with the envelope 14. Thus, as shown in FIG. 2A, a clearance 24 is created between ring 22 and the envelope 14.

In the cruising phase, the expansion of the envelope 14 has reached its maximum, the ring 22 continues its expansion and joins the envelope 14, thus creating a slight locking or tightening.

In the deceleration phase, the temperature outside the envelope 14 drops, so that the latter contracts. However, as the contraction of the ring 22 requires on the one hand a greater temperature drop than that required by the envelope and on the other as the latter is thermally protected within the cavity, under these conditions the said ring 22 holds the envelope by the locking action 26, as shown in FIG. 2B. The contraction of the envelope 14 is therefore delayed compared with its "normal" contraction, i.e. the contraction which it would undergo in the absence of the ring 22 in the cavity 16.

Figure 3:
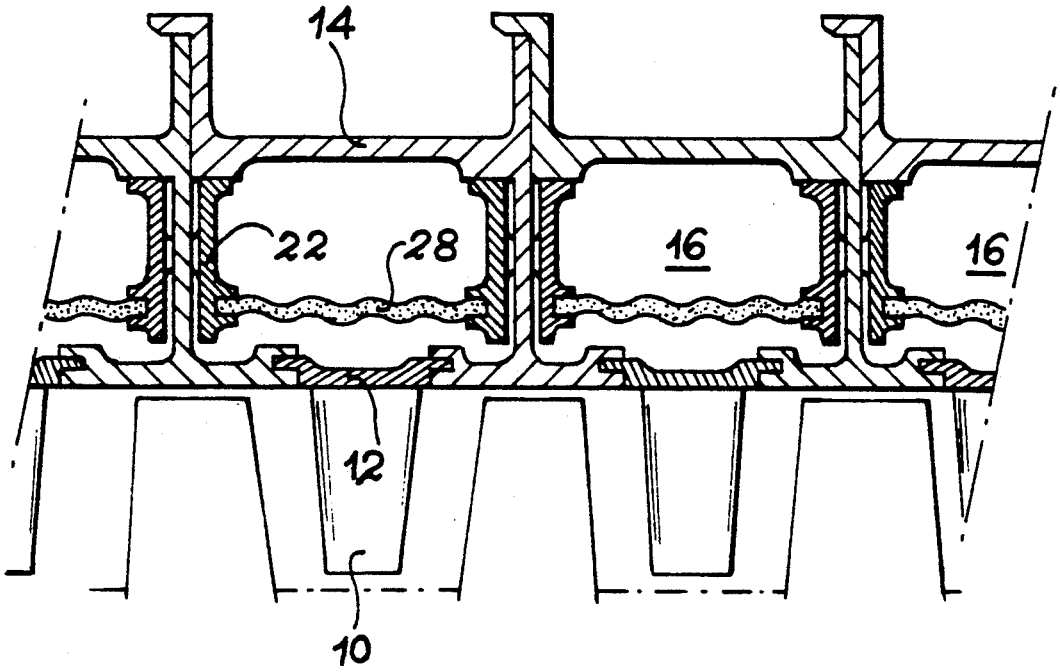
FIG. 3 is a partially diagrammatic view in accordance with the same cross-section as FIGS. 2A and 2B showing a variant of the ring according to the invention.

An improved embodiment of the invention consists of introducing into the device thermal insulating means 28, as shown in FIG. 3. More specifically, these insulating means 28 constitute part of the ring 22 and make it possible to limit heat exchanges between the outer part of the casing (i.e., outer envelope and cavity) and the rotor.

Figure 4:
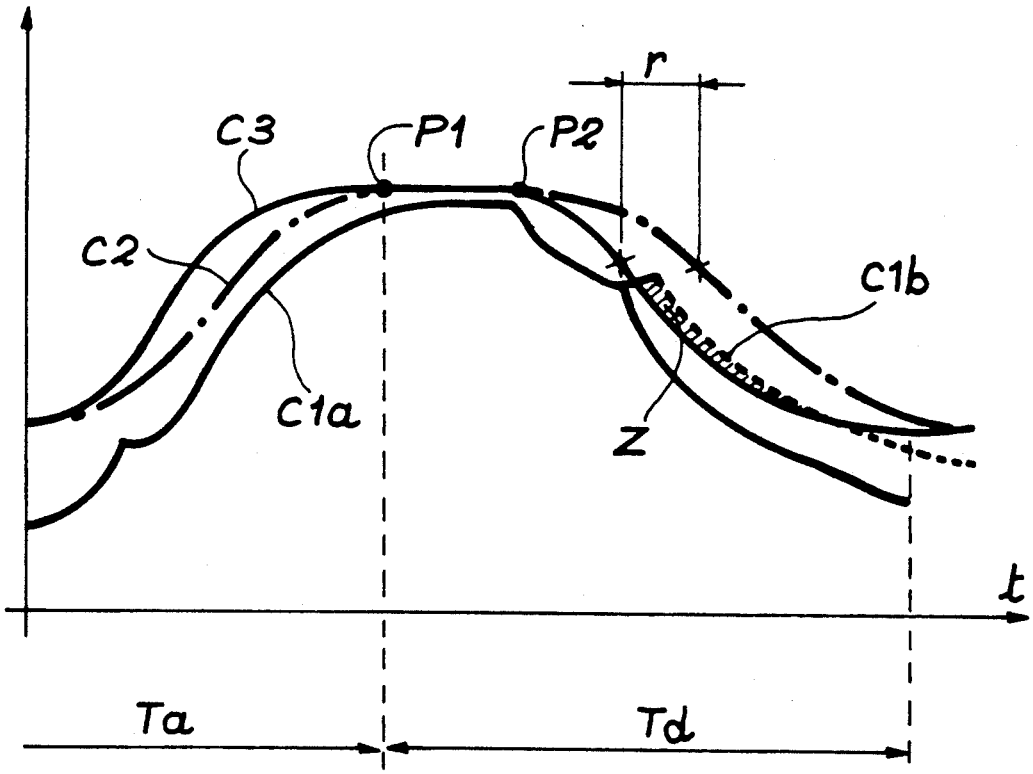
FIG. 4 is a graph showing the evolution in time of the expansion/contraction state of the ring and the structure of the casing for different flight phases.

FIG. 4 is a graph showing the evolution in time of the expansion/contraction phenomenon of the casing structure with and without the ring. In the said graph, the curves are shown as a function of the time t on the abscissa, and the temperature T on the ordinate. The curves C1a and C1b represent the speed of the rotor during the accelerating phase Ta and the decelerating phase Td. The curve C1a represents the case of an acceleration and a deceleration of the rotor, while the curve C1b represents the case of an acceleration and a deceleration with reacceleration of the rotor.

Curves C2 and C3 represent the evolution of the casing in the respective cases where there is a ring in the cavity and where no such ring exists. More specifically, in phase Ta, the curve C2 shows the evolution of the expansion of the ring and curve C3 the evolution of the expansion of the casing structure. It can be seen that the ring expands more slowly than the structure, the curve C2 rising more slowly than the curve C3. Between the points P1 and P2, the expansion state of the structure is at its maximum, so that said structure is locked to the ring, whose expansion is significantly limited because it is in contact with the structure. During the decelerating phase Td, the ambient temperature drops and the casing structure contracts, as illustrated by the curve C3, when there is no ring in the cavity. Under the same phase conditions Td, the curve C2 decreases with a certain time lag r compared with that of the curve C3, said lag r being the consequence of the higher value of the thermal inertia of the ring compared with that of the structure. Thus, during the time interval corresponding to said lag, it is possible to reaccelerate the rotor without any risk of mechanical interference between the rotor and the stator. Thus, it can be seen that the curve C1b which represents this case of deceleration with reacceleration, intersects the curve C3 (expansion of the casing without the ring) in a mechanical interference zone Z. The latter does not exist when the casing has rings in its cavities, the curve C1b not intersecting the curve C2 (expansion of the casing with ring).

Figure 5:
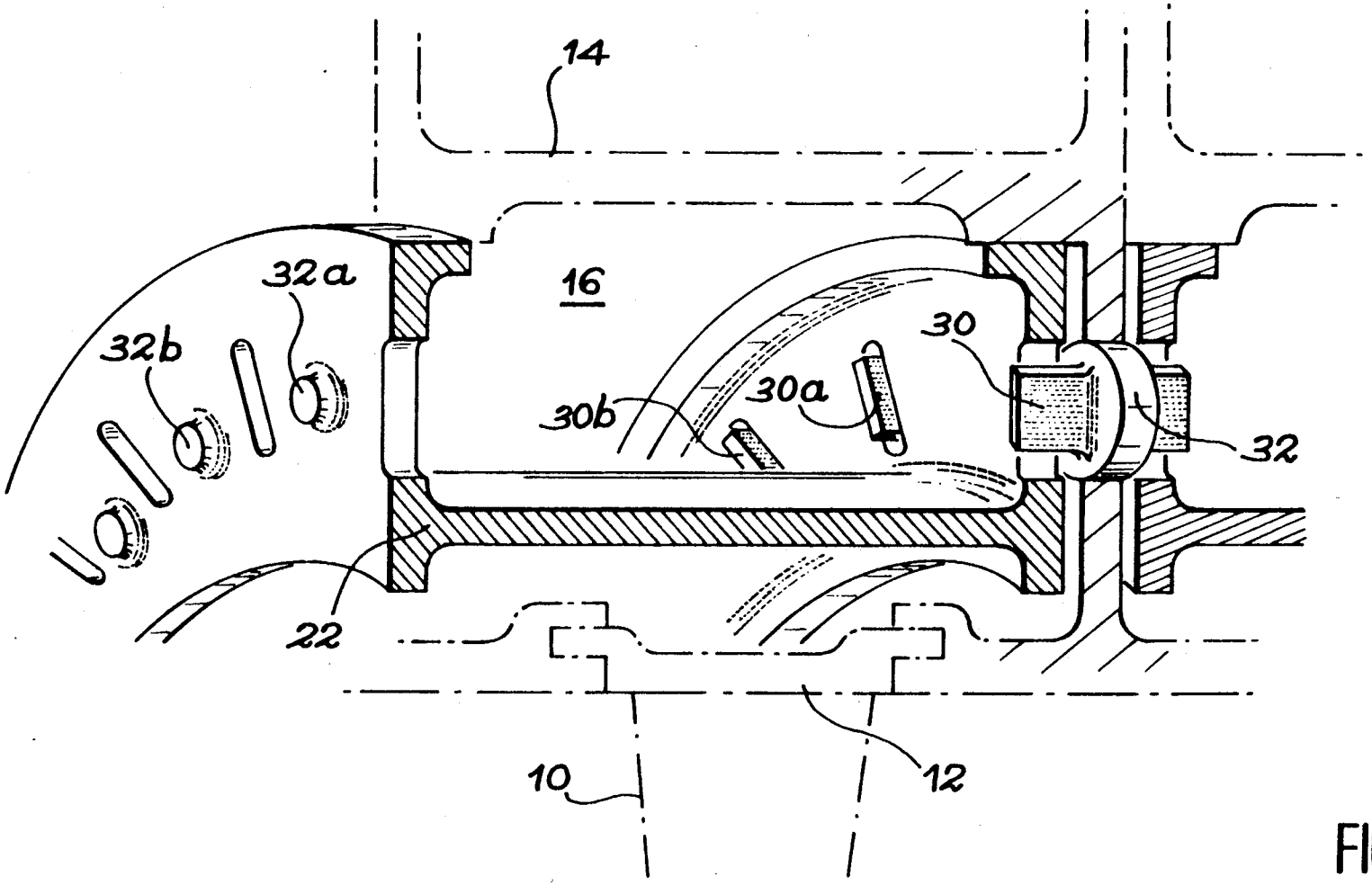
FIG. 5 is a partially diagrammatic view in perspective of the casing and one of its rings.

FIG. 5 is a perspective view in a longitudinal section corresponding to that of FIGS. 2A,2B and 3 of that part of the casing shown in FIGS. 2A, 2B and 3. Apart from the outer 14 and inner 12 envelopes shown in mixed line form, it is possible to see the ring 22 fixed in the cavity 16 by means of radial slides 30 and lugs 32. The radial slides 30 are mounted in the rings sliding on the lugs 32, which themselves pivot in the casing structure 12–14. This pivoting of the ring supports (namely the assembly constituted by the lug 32 and the slide 30) permits a free expansion/contraction of the ring.

This longitudinal section of the casing in perspective reveals several radial slides 30*a*,30*b*, etc. and several lugs 32*a*, 32*b*, etc., ensuring the supporting of several rings, which are not shown in the drawing. For simplification purposes, the preceding drawings have only shown a single cavity containing a single ring. However, it is obvious that each casing cavity can have a ring as described hereinbefore.

Figure 6:
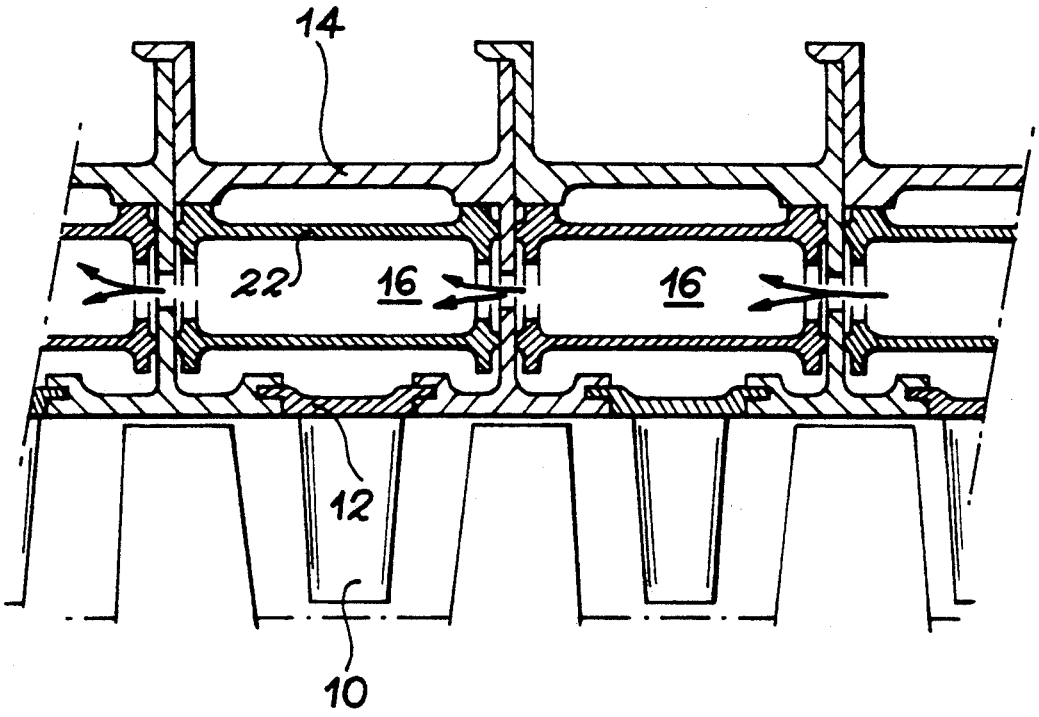
FIG. 6 a partially diagrammatic view of the same cross-section as in FIGS. 2A and 2B but showing an improved embodiment of the invention.

An improved embodiment of the invention shown in FIG. 6 consists of introducing, at the sector, an air ventilating system making it possible to more accurately control the already described expansion/contraction phenomenon. This improvement of the invention consists of introducing hot air into the cavities 16, as is illustrated by the arrows in the drawing and this air comes from a source outside the stator (e.g. coming from the rear of the HP compressor) and is controlled by a valve.

Thus, the control of the internal diameter of the casing is made active, i.e. controllable on the basis of two parameters, namely the expansion coefficient of the ring and the ambient temperature within the cavities.

Obviously, numerous modifications and variations of the present invention are possible in light of the above teachings. It is therefore to be understood that within the scope of the appended claims, the invention may be practiced otherwise than as specifically described herein.

We claim:

1. Gas turbine compressor casing having a structure forming a casing, which comprises:

a locking member having a thermal inertia higher than that of said structure and mounted in said structure so as to limit contraction of the casing during a temperature drop wherein said structure forming the casing has an inner envelope and an outer envelope forming at least one closed cavity.

2. Casing according to claim 1, wherein the locking member comprises a material having a lower thermal expansion coefficient than that of said structure.

3. Casing according to claim 1, which comprises a ventilating system for ensuring hot air circulation in said structure.

4. Casing according to claim 1, wherein said locking member comprises a ring.

5. Casing according to claim 4, wherein the ring cooperates with said structure by guidance means for opposing rotation of the ring about an axis of the casing.

6. Casing according to claim 5, wherein the guidance means comprises a support positioned in partitions of said structure for ensuring free expansion and/or contraction of the ring.

7. Casing according to claim 1, which comprises thermal insulating means arranged around the inner envelope.

8. Casing according to claim 7, wherein the thermal insulating means comprises a substantially cylindrical part of the locking member.

9. Gas turbine compressor casing having a structure forming a casing, which comprises:

a locking member having a thermal inertia higher than that of said structure and mounted in said structure so as to limit contraction of the casing during a temperature drop wherein said structure forming the casing has an inner envelope and an outer envelope forming at least one closed cavity, and wherein said locking member is independent of the structure which forms said casing.

* * * * *